United States Patent [19]

Peters

[11] 4,438,930

[45] Mar. 27, 1984

[54] ROLLOVER SWITCH APPARATUS

[75] Inventor: Albin Peters, Chicago, Ill.

[73] Assignee: Wico Corporation, Niles, Ill.

[21] Appl. No.: 297,117

[22] Filed: Aug. 28, 1981

[51] Int. Cl.[3] ..... A63D 13/00

[52] U.S. Cl. ..... 273/127 R

[58] Field of Search ..... 273/127 R, 127 A, 118 R, 273/118 A, 119 A, 119 R, 121 R, 121 A, 122 A, 122 R, 123 R, 123 A, 124 R, 124 A, 125 R, 125 A; 200/61.1, 61.11

[56] References Cited

U.S. PATENT DOCUMENTS

| | | | |
|---|---|---|---|
| 2,093,293 | 9/1937 | Stoner et al. | 273/121 A |
| 2,253,796 | 8/1941 | Livingston | 273/118 A |
| 2,258,329 | 10/1941 | MacDougall et al. . | |
| 2,263,727 | 11/1941 | Gensburg . | |
| 2,544,945 | 3/1951 | Williams . | |
| 3,063,719 | 11/1962 | Rosenberger . | |
| 3,452,988 | 7/1969 | Zale | 273/127 |
| 3,627,318 | 12/1971 | Garbary et al. | 273/121 A |
| 3,675,927 | 7/1972 | Gottlieb et al. | 273/119 A |
| 4,180,267 | 12/1979 | Harrop | 273/127 R |

*Primary Examiner*—Richard T. Stouffer
*Assistant Examiner*—William H. Honaker
*Attorney, Agent, or Firm*—Dithmar, Stotland, Stratman & Levy

[57] ABSTRACT

The rollover switch apparatus includes a one-piece plastic base, a switch attached thereto and a one-piece plastic actuator having an arm pivotally attached to the base and means engaged by the rolling pinball to move the actuator from its rest position to an actuating position.

8 Claims, 5 Drawing Figures

ROLLOVER SWITCH APPARATUS

BACKGROUND OF THE INVENTION

A pinball game has a playfield board and a number of pinballs which are propelled usually one after another onto the board. Located on the board are various kinds of ball objectives and targets which when struck register a score. One of the objectives or targets may be a channel or passageway for the ball. A switch is operated when the ball rolls through said passageway to register a score. The actuator for such switch includes a portion that protrudes through the playfield board and is contacted by the ball causing the switch located beneath the board to close. Such a switch commonly has a pair of leaf springs, one of which is arranged to move toward and away from the other. In the past, the actuator was a piece of wire bent to form a ball engaging portion which protruded through the playfield board and a second portion which engaged or was attached to one of the leaf-spring members.

Such actuators had a tendency to become deformed during use and would eventually have to be replaced.

SUMMARY OF THE INVENTION

It is therefore an important object of the present invention to provide a rollover switch apparatus in which the actuator is more rigid than currently available actuators made of wire.

In summary, there is provided a rollover switch apparatus for mounting a switch in a pinball game including a playfield board upon which a pinball rolls and which has at least one opening therein, the switch having one leaf-spring member movable toward and away from another leaf-spring member, the rollover switch apparatus comprising a one-piece plastic base for attachment to the underside of the playfield board and to which the switch is adapted to be attached, a one-piece plastic actuator having an arm pivotally attached to said base and having ball-engaging means and leaf-spring engaging means, the actuator having a rest position and an actuating position, the actuator being costructed so that in the rest position thereof the leaf-spring engaging means is spaced from the one leaf-spring member and the ball-engaging means protrudes through the opening in the palyfield board, and being further constructed so that in the actuating position thereof the leaf-spring engaging means moves the one leaf-spring member into engagement with the other leaf-spring member when a pinball engages the ball-engaging means.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages, of the invention.

BRIEF DESCRIPTION OF THE DRAWINGS

For the purpose of facilitating an understanding of the invention, there is illustrated in the accompanying drawings, a preferred embodiment thereof, from an inspection of which, when considered in connection with the following description, the invention, its construction, and operation, and many of its advantages should be readily understood and appreciated.

DESCRIPTION OF THE PREFERRED EMBODIMENT

Figure 1:
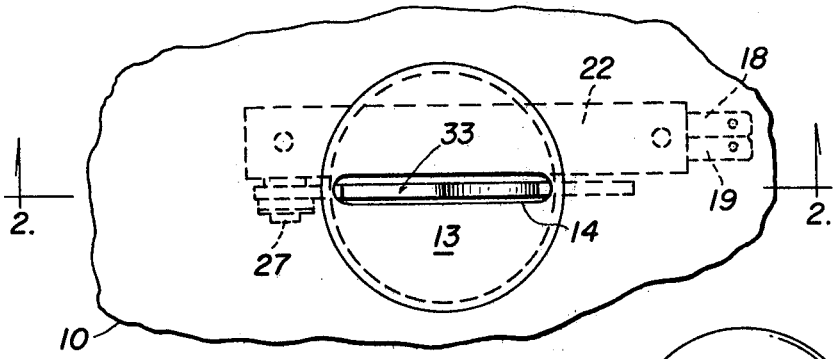
FIG. 1 depicts a fragmentary portion of a playfield board on which a rollover switch apparatus incorporating the features of the present invention is shown dotted.

Turning now to the drawings,there is shown a playfield board 10 of a pinbal game. A pinball 11 having been projected onto the playfield board 10 by means not shown, travels in the direction indicated by the arrow. In the playfield board 10 are cylindrical openings 12, each having a cup-like disc 13 disposed therein. The disc 13 has a diametrically extending slot 14. Instead of using round openings and discs, the slots could be formed directly into the playfield board 10.

Mounted to the underside of the playfield board 10 is a rollover switch apparatus 15 which includes a switch 16 connected by wires (not shown) to the pinball game scoreboard. When the pinball 11 passes over the slot 14, the switch 16 closes, to cause the scoreboard to display the scoring event. The switch 16 includes a body 17 which carries a pair of leaf springs 18 and 19, having associated therewith the usual button contacts **18*a* and 19*a*. The leaf spring 18 is longer than the leaf spring 19 and is arranged to move toward and away from the leaf spring 19**.

The rollover switch apparatus 15 furyther comprises a one-piece plastic base 20. The base 20 is elongated and includes a body 21, a leg 22 at one end thereof, and a depending foot 23 at the other end of the leg 22. The leg 22 and the foot 23 have a planar surface for contact with the underside of the playfield board 10, which surface has a recess therein for material conservation. The base 20 further includes a shoulder 24 extending from the lower end of the base 20 in a direction generally parallel to the leg 22. The facing surfaces of the leg 22 and the shoulder 24 constitute stop surfaces 25 and 26 respectively. Extending laterally from the side of the body 21 is a pin 27.

The switch 16 is attached to the base 20 by means of a screw 28 extending through the switch body 17 into the foot 23. The entire rollover switch apparatus 16 is attached by means of one screw 29 passing through the switch body 17 and the foot 23 into the playfield board 10 and another screw 29 passing through the body 21 into the playfield board.

The rollover switch apparatus 15 further comprises a one-piece plastic actuator 30 having an elongated arm 31, one end of which arm carries a socket 32 that pivotally receives the pin 27. The arm 31 carries, on the other end thereof, a generally U-shaped finger 33 having a shallow V-shaped, ball-engagement bight 34, thereby to define camming surfaces 35. The arm 31 also carries an elongated tab 36 extending laterally in a direction opposite tothe direction of the pin 27. The arm 31 and the U-shaped finger 33 have a generally C-shaped cross section for conserving material. The actuator 30 is held onto the base 20 by means of a washer 38 and a retaining ring 39. The tab 36 is located between and constrained by the stop surfaces 25 and 26.

Figure 2:
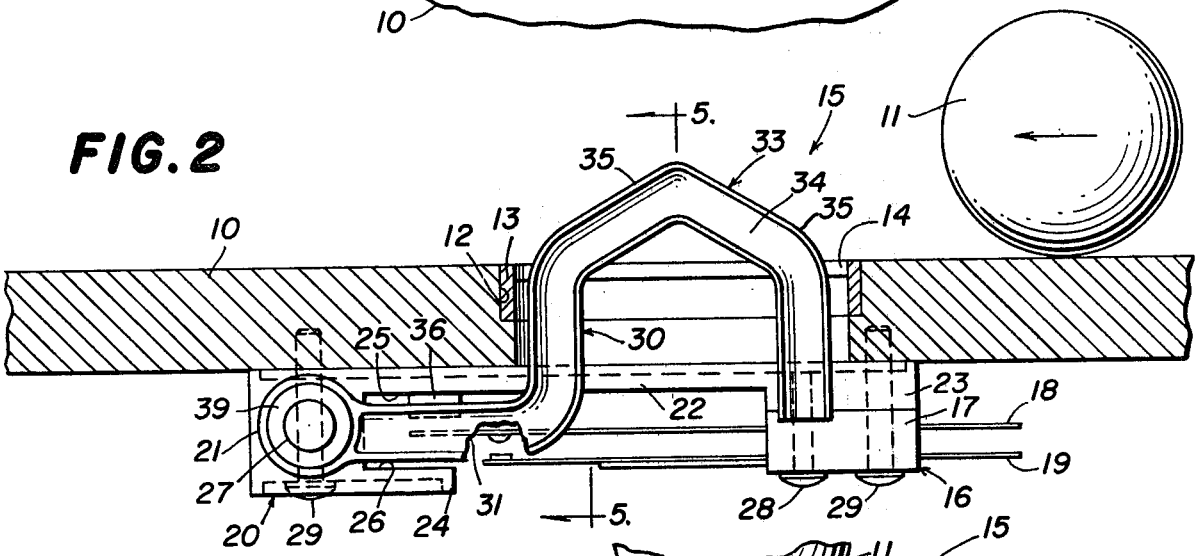
FIG. 2 is a view, on a slightly enlarged scale, in vertical section taken along the line 2—2 of FIG. 1.
Figure 3:
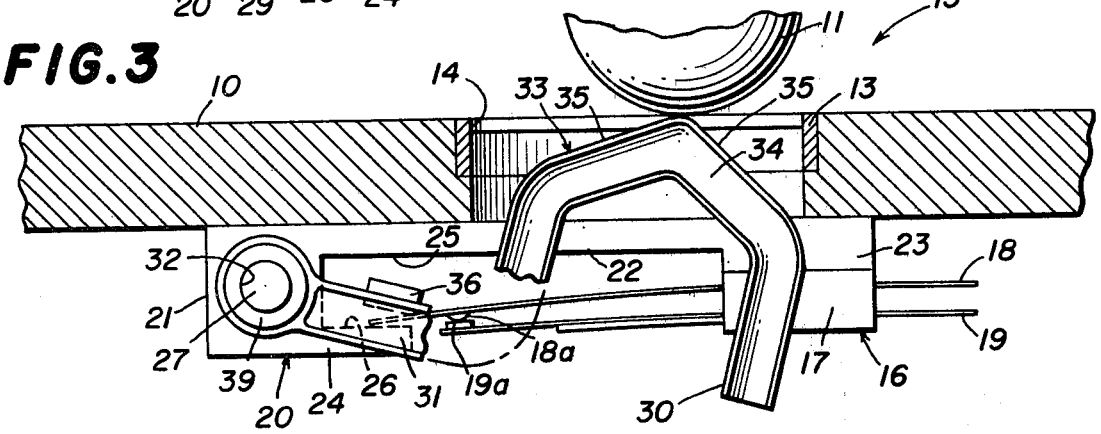
FIG. 3 is a view like FIG. 2 but showing the actuator in its actuating position.
Figure 5:
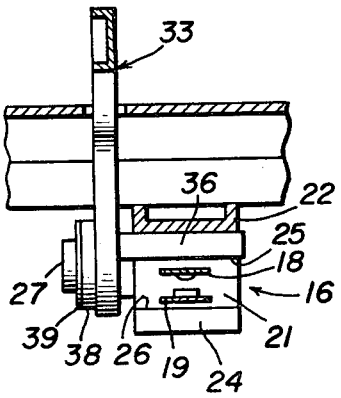
FIG. 5 is a view in section taken along the line 5—5 of FIG. 2.
Figure 4:
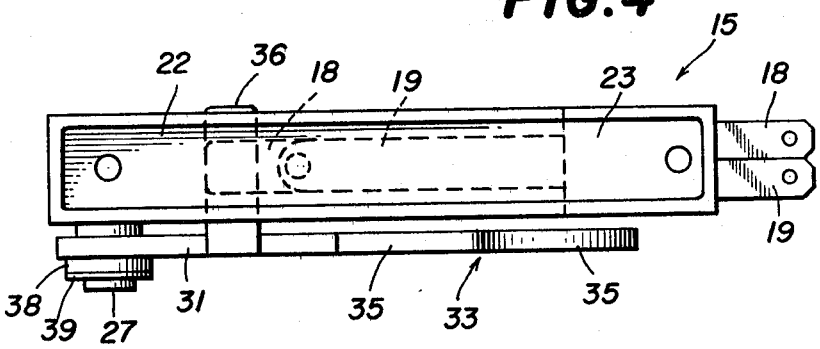
FIG. 4 is a top plan view of the rollover switch apparatus.

The actuator 30 is depicted in its rest position in FIG. 2. The V-shaped bight 34 is located above the upper surface of the playfield board 10 and the tab 36 is adjacent the stop surface 25 or perhaps even in contact with it as shown in FIG. 2. When the pinball 11 strikes either of the camming surfaces 35, the actuator 30 is pivoted to its actuating position as shown in FIG. 3. The tab 36 engages the leaf spring 18 and carries it downwardly into contact with the leaf spring 19, further movement being prevented by the distal end of the leaf spring 18 contacting the stop surface 26.

The actuator 30 is preferably translucent, whereby a light source mounted beneath the switch assembly would illuminate the finger 33.

What has been described therefore is an improved rollover switch apparatus which is inexpensive to manufacture yet will not become deformed during use.

I claim:

1. Rollover switch apparatus for use in a pinball game including a playfield board upon which a pinball rolls and which has at least one opening therein, said rollover switch apparatus comprising a switch having two leaf-spring members, one said leaf-spring member being movable toward and away from the other said leaf-spring member, said an elongated one-piece plastic base for attachment to the underside of the playfield board, said base having a body portion and a leg portion carried by said body portion and a foot portion carried by said leg portion, said switch being fixedly attached to said foot portion, a stop member carried by said body portion and projecting therefrom parallel to said leg portion and spaced therefrom, an elongated rigid one-piece plastic actuator channel-shaped in transverse cross section along the entire length thereof and pivotally attached to said body portion for movement between a rest position and an actuating position, said actuator having a ball-engaging portion, a leaf-spring engaging member carried by said actuator, said leaf-spring engaging member being elongated in a direction normal to the direction of elongation of said actuator and extending between said leg portion and said stop member for cooperation therewith to limit the pivotal movement of said actuator, said ball-engaging portion being adapted to protrude through the opening in the playfield board and said leaf spring members being spaced apart when said actuator is in the rest position thereof, said leaf-spring engaging member engaging said one leaf-spring member and holding it in engagement with said other leaf-spring member when said actuator is in the actuating position thereof, said actuator being adapted to respond to engagement of said ball-engaging portion by a pinball for moving from the rest position to the actuating position.

2. The rollover switch apparatus of claim 1, wherein said base is elongated, said switch is attached adjacent to one end of said base, and said actuator is attched adjacent to the other end of said base.

3. The rollover switch apparatus of claim 1, wherein said switch has a body fixedly attached to said foot portion, said two leaf-spring members extending from said body between said leg portion and said stop member.

4. The rollover switch apparatus of claim 1, and further comprising fastener means for attaching said body portion to the underside of the playfield board and further fastener means for attaching said foot portion to the underside of said playfield board.

5. The rollover switch apparatus of claim 1, wherein said actuator carries a socket at one end thereof and said ball engaging portion at the other end thereof, and said base includes a pin extending into said socket.

6. The rollover switch apparatus of claim 5, and further comprising a retaining ring attached to the distal end of said pin to retain said actuator on said base while permitting pivotal motion of said actuator.

7. The rollover switch apparatus of claim 5, wherein said base is elongated and said pin protrudes in a direction perpendicular to the direction of elongation.

8. The rollover switch assembly set forth in claim 1, wherein said actuator is translucent.

* * * * *

UNITED STATES PATENT AND TRADEMARK OFFICE

CERTIFICATE OF CORRECTION

PATENT NO. : 4,438,930

DATED : March 27, 1984

INVENTOR(S) : Albin Peters

It is certified that error appears in the above-identified patent and that said Letters Patent are hereby corrected as shown below:

Column 3, line 25, after "member," delete "said".

Signed and Sealed this

*Seventeenth* Day of *July 1984*

[SEAL]

*Attest:*

GERALD J. MOSSINGHOFF

*Attesting Officer*

*Commissioner of Patents and Trademarks*